US008622777B1

(12) United States Patent
McNalley et al.

(10) Patent No.: US 8,622,777 B1
(45) Date of Patent: Jan. 7, 2014

(54) SYSTEMS AND METHODS FOR CONTROLLING TRIM AND MANEUVERING A MARINE VESSEL

(75) Inventors: Brett J. McNalley, Oshkosh, WI (US); William R. Robertson, Oshkosh, WI (US); Kenneth G. Gable, Oshkosh, WI (US)

(73) Assignee: Brunswick Corporation, Lake Forest, IL (US)

( * ) Notice: Subject to any disclaimer, the term of this patent is extended or adjusted under 35 U.S.C. 154(b) by 246 days.

(21) Appl. No.: 13/157,128

(22) Filed: Jun. 9, 2011

(51) Int. Cl.
*B63H 21/22* (2006.01)

(52) U.S. Cl.
USPC ..... 440/1; 440/53; 440/84

(58) Field of Classification Search
USPC ..... 114/284, 285; 440/1, 53, 86, 84; 701/21
See application file for complete search history.

(56) References Cited

U.S. PATENT DOCUMENTS 4,824,407 A 4/1989 Torigai et al.
4,872,857 A 10/1989 Newman et al.
4,898,563 A 2/1990 Torigai et al.
4,908,766 A 3/1990 Takeuchi
5,118,315 A * 6/1992 Funami et al. ..... 440/1
5,474,013 A 12/1995 Wittmaier
5,785,562 A 7/1998 Nestvall
5,788,545 A 8/1998 Borgersen et al.
6,234,853 B1 5/2001 Lanyi et al.
6,354,237 B1 3/2002 Gaynor et al.
6,458,003 B1 10/2002 Krueger
6,994,046 B2 2/2006 Kaji et al.
6,997,763 B2 * 2/2006 Kaji ..... 440/1
7,267,068 B2 9/2007 Bradley et al.
7,416,456 B1 8/2008 Gonring et al.
7,467,595 B1 12/2008 Lanyi et al.
7,530,866 B2 5/2009 Darby et al.
7,617,026 B2 11/2009 Gee et al.

* cited by examiner

*Primary Examiner* — Lars A Olson
(74) *Attorney, Agent, or Firm* — Andrus, Sceales, Starke & Sawall, LLP

(57) ABSTRACT

Systems and methods for maneuvering a marine vessel limit interference by the hull of the vessel with reverse thrust. A marine propulsion device provides at least a reverse thrust with respect to the marine vessel. The propulsion device is vertically pivotable into a trim position wherein the hull does not impede or interfere with the reverse thrust. A control circuit controls the propulsion device to move into the trim position when the reverse thrust of the propulsion device is requested.

19 Claims, 7 Drawing Sheets

SYSTEMS AND METHODS FOR CONTROLLING TRIM AND MANEUVERING A MARINE VESSEL

FIELD

The present disclosure relates to marine vessels, and more particularly to systems and methods for controlling the trim angle of propulsion devices on marine vessels.

BACKGROUND

The disclosure of U.S. Pat. No. 4,872,857 is hereby incorporated herein by reference and discloses systems for optimizing operation of a marine drive of the type whose position may be varied with respect to the boat by the operation of separate lift and trim/tilt means.

The disclosure of U.S. Pat. No. 7,416,456 is hereby incorporated herein by reference and discloses an automatic trim control system that changes the trim angle of a marine propulsion device as a function of the speed of the marine vessel relative to the water in which it is operated.

The disclosures of U.S. Pat. Nos. 6,234,853; 7,267,068; and 7,467,595 are hereby incorporated herein by reference and disclose methods and apparatuses for maneuvering multiple engine marine vessels.

SUMMARY

This disclosure derives from the present inventors' research and development of systems and methods for maneuvering marine vessels. Through experimentation, the inventors have determined that prior art systems and methods for maneuvering marine vessels often position one or more marine propulsion devices at inefficient and/or ineffective trim angles during certain operational modes. For example, the present inventors have determined upon initiation of docking modes, when a joystick or other input device is utilized to request transverse, rotational, or reverse movements of the marine vessel, the marine propulsion devices are often oriented at a trim angle such that reverse thrusts of the devices impact the hull of the marine vessel. The inventors have determined that this creates inefficiency in the operation of the system. This type of deficiency also occurs during other operational modes, such as upon initiation of stationkeeping modes wherein the marine propulsion devices are oriented to maintain a global position of the marine vessel, and upon initiation of reverse modes wherein the propulsion devices provide reverse thrusts to achieve reverse translation of the marine vessel. The present inventors have realized that during modes when reverse thrust is utilized, and especially during modes when a plurality of propulsion devices are splayed inwardly, fully trimming down the propulsion devices can result in an inefficient and possibly ineffective use of reverse thrust. Similarly, trimming the plurality of propulsion devices too far upwardly away from vertical underutilizes the thrusts, thus resulting in inefficiency. Upon this realization, the present inventors determined that it would be beneficial to provide systems and methods that automatically trim the one or more marine propulsion devices to an optimal trim angle when reverse thrusts from the propulsion devices are or will be requested.

In one example disclosed herein, a system for maneuvering a marine vessel comprises an input device for requesting a reverse thrust of a marine propulsion device and a control circuit that, based upon the request for the reverse thrust from the input device, controls movement of the marine propulsion device into a trim position wherein the marine propulsion device provides a reverse thrust that is not impeded by a hull of the marine vessel. Optionally, the input device can comprise a joystick.

In another example disclosed herein, a system for maneuvering a marine vessel comprises a marine propulsion device that provides at least a reverse thrust with respect to the marine vessel. The propulsion device is vertically pivotable between at least a first trim position and a second trim position, wherein the hull of the marine vessel impedes the reverse thrust of the propulsion device in the first trim position to a larger degree than when the propulsion device is in the second trim position. A control circuit controls the propulsion device to move into the second trim position when the reverse thrust of the propulsion device is requested.

In a further example, the propulsion device in the first trim position defines a reverse thrust vector in a direction that intersects with the hull and the propulsion device in the second trim position defines a reverse thrust vector in a direction that does not intersect with the hull of the marine vessel. In a further example, the propulsion device in the first trim position is at a greater trim angle from vertical than when the propulsion device is in the second trim position.

Optionally, the control circuit can control operation of the propulsion device according to an operational mode that requests the reverse trust. For example, the operational mode can comprise a stationkeeping mode wherein the control circuit controls operation of the marine propulsion device to maintain a global position of the marine vessel; a docking mode wherein the control circuit controls operation of the propulsion device to achieve a transverse or rotational movement of the marine vessel; or a reverse mode wherein the control circuit controls operation of the propulsion device to achieve reverse translation of the marine vessel.

In a further example, a method of maneuvering a marine vessel, the method comprises operating a control circuit to process a request for reverse thrust of a marine propulsion device associated with the marine vessel; and controlling with the control circuit the marine propulsion device to move into a trim position wherein the marine vessel does not impede the reverse thrust.

In a further example, a method of maneuvering a marine vessel comprises operating a control circuit to process a request for reverse thrust of a marine propulsion device associated with the marine vessel; and controlling with the control circuit the marine propulsion device to move from a first trim position to a second trim position, wherein the marine vessel impedes the reverse thrust in the first trim position to a larger degree than when the propulsion device is in the second trim position.

DETAILED DESCRIPTION OF THE DRAWINGS

Figure 2:
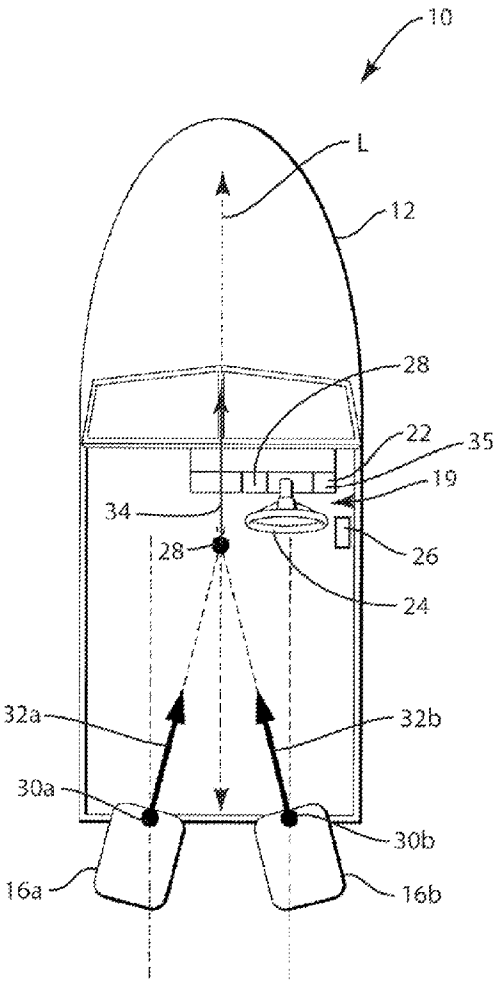
FIG. 2 is a schematic depiction of a marine vessel having a plurality of marine propulsion devices in an unaligned position.

In the present description, certain terms have been used for brevity, clearness and understanding. No unnecessary limitations are to be implied therefrom beyond the requirement of the prior art because such terms are used for descriptive purposes only and are intended to be broadly construed. The different systems and methods described herein may be used alone or in combination with other systems and methods. Various equivalents, alternatives and modifications are possible within the scope of the appended claims. Each limitation in the appended claims is intended to invoke interpretation under 35 U.S.C. §112, sixth paragraph only if the terms "means for" or "step for" are explicitly recited in the respective limitation.

FIGS. 1-8 schematically depict components of a system 10 for maneuvering and orienting a marine vessel 12. The system 10 includes among other things a control circuit 14 (see FIG. 8) for controlling the rotational position, trim position, and thrust generation of a plurality of marine propulsion devices 16*a*, 16*b* based upon inputs from an input device. It should be understood that the particular configurations of the system 10 and marine vessel 12 are exemplary. It is possible to apply the concepts described in the present disclosure with substantially different configurations for systems for maneuvering and orienting marine vessels and with substantially different marine vessels.

For example, the control circuit 14 (see FIG. 8) is shown in simplified schematic form and has a plurality of command control sections 18*a*, 18*b* located at a helm 19 of the marine vessel 12 that communicate with respective engine control sections 20*a*, 20*b* associated with each marine propulsion device 16*a*, 16*b*, steering control sections 21*a*, 21*b* associated with steering actuators 23*a*, 23*b* for steering each marine propulsion device 16*a*, 16*b*, and trim control sections 31*a*, 31*b*, associated with trim actuators 33*a*, 33*b* for changing the trim angles of each marine propulsion device. However, the control circuit 14 can have any number of sections (including for example one section) and can be located remotely from or at different locations in the marine vessel 12 from that shown. For example, the trim control sections 31*a*, 31*b* can be co-located with and/or part of the engine control sections 20*a*, 20*b*. Other similar modifications of this type can be made. It should also be understood that the concepts disclosed in the present disclosure are capable of being implemented with different types of control systems including systems that acquire global position data and real time positioning data, such as for example global positioning systems, inertial measurement units, and the like.

Further, certain types of input devices such as a joystick 22, a steering wheel 24, a shift/throttle lever 26, a keypad 35 and a touchscreen 28 are described. It should be understood that the present disclosure is applicable with other numbers and types of input devices such as video screens, keyboards, voice command modules, and the like. It should also be understood that the concepts disclosed in the present disclosure are able to function in a preprogrammed format without user input or in conjunction with different types of input devices, as would be known to one of ordinary skill in the art. Further equivalents, alternatives and modifications are also possible as would be recognized by one of ordinary skill in the art.

Further, a marine vessel 12 having two (i.e. first and second) marine propulsion devices 16*a*, 16*b* is described; however the concepts in the present disclosure are applicable to marine vessels having any number of marine propulsion devices. Configurations with one or more marine propulsion devices are contemplated. For example, parts of this disclosure and claims refer to "a propulsion device". These descriptions are intended to equally apply to arrangements having "one or more propulsion devices." The concepts in the present disclosure are also applicable to marine vessels having any type or configuration of propulsion device, such as for example electric motors, internal combustion engines, and/or hybrid systems configured as an inboard drives, outboard drives, inboard/outboard drives, stern drives, and/or the like. The propulsion devices can include any different type of propulsor(s) such as propellers, impellers, pod drives, and/or the like.

Figure 1:
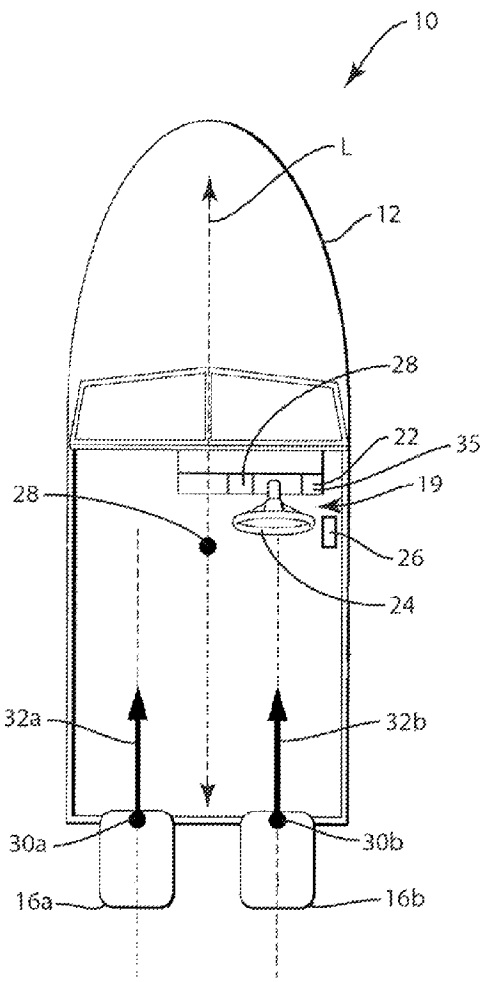
FIG. 1 is a schematic depiction of a marine vessel having a plurality of marine propulsion devices in an aligned position.

In FIGS. 1 and 2, a marine vessel 12 is schematically illustrated and has first and second marine propulsion devices 16*a*, 16*b*, which in the example shown are outboard internal combustion engines. Again, the number of propulsion devices can vary from that shown. The marine propulsion devices 16*a*, 16*b* are each rotatable in clockwise and counterclockwise directions through a substantially similar range of rotation about respective first and second steering axes 30*a*, 30*b*. Rotation of the marine propulsion devices 16*a*, 16*b* is facilitated by conventional steering actuators 23*a*, 23*b* (see FIG. 8). Steering actuators for rotating marine propulsion devices are well known in the art, examples of which are provided in the incorporated U.S. Pat. No. 7,467,595. Each marine propulsion device 16*a*, 16*b* creates propulsive thrust in both a forward and reverse direction. FIGS. 1 and 2 show both marine propulsion devices 16*a*, 16*b* providing reverse thrusts 32*a*, 32*b*; however it should be recognized that either or both propulsion devices 16*a*, 16*b* could instead provide forward thrusts.

As shown in FIG. 1, the propulsion devices 16*a*, 16*b* are aligned in a longitudinal direction L to thereby define thrusts 32*a*, 32*b* extending in the longitudinal direction L. The particular orientation shown in FIG. 1 is typically employed to achieve either a forward or backward movement of the marine vessel 12 in the longitudinal direction L or a rotational movement of the marine vessel 12 with respect to the longitudinal direction L. Specifically, application of both thrusts 32*a*, 32*b* forwardly in the longitudinal direction L (i.e. oppositely of the orientation shown in FIG. 1) causes the marine vessel 12 to move forward in the longitudinal direction L. Conversely, application of thrusts 32*a*, 32*b* reversely in the longitudinal direction L (such as is shown in FIG. 1) causes the marine vessel 12 to move reversely in the longitudinal direction L. Further, opposite application of respective thrusts 32*a*, 32*b* (i.e. one forwardly and one reversely) causes rotation of the marine vessel 12 about a center of turn 28 for the marine vessel 12 and with respect to the longitudinal direction L. In this example, reverse application of thrust 32*a* and forward application of thrust 32*b* causes clockwise rotation of the marine vessel 12 about the center of turn 28, whereas forward application of thrust 32*a* and reverse application of thrust 32*b* causes counter-clockwise rotation of marine vessel about the center of turn 28. Various other maneuvering strategies and mechanisms are described in the incorporated U.S. Pat. Nos. 6,234,853; 7,267,068; and 7,467,595.

In this example, the center of turn 28 represents an effective center of gravity for the marine vessel 12. It will be understood by those having ordinary skill in the art that the location of the center of turn 28 is not, in all cases, the actual center of gravity of the marine vessel 12. That is, the center of turn 28 can be located at a different location than the actual center of gravity that would be calculated by analyzing the weight distribution of the various components of the marine vessel. Maneuvering a marine vessel 12 in a body of water results in reactive forces exerted against the hull of the marine vessel 12 by the wind and the water. For example, as various maneuvering thrusts are exerted by the first and second marine propulsion devices 16*a*, 16*b* the hull of the marine vessel 12 pushes against the water and the water exerts a reaction force against the hull. As a result, the center of turn identified as 28 in FIGS. 1 and 2 can change in response to different sets of forces and reactions exerted on the hull of the marine vessel 12. This concept is recognized by those skilled in the art and is referred to as the instantaneous center of turn in U.S. Pat. No. 6,234,853 and as the instantaneous center in U.S. Pat. No. 6,994,046.

As shown in FIG. 2, the marine propulsion devices 16*a*, 16*b* are rotated out of the aligned position shown in FIG. 1 so that the marine propulsion devices 16*a*, 16*b* and resultant thrusts 32*a*, 32*b* are not aligned in the longitudinal direction L. In the example shown in FIG. 2, the marine propulsion devices 16*a*, 16*b* are splayed inwardly and operated so as to provide thrusts 32*a*, 32*b* that each intersect with the center of turn 28. In this orientation, all movement of the marine vessel 12 would occur without rotation of the marine vessel 12 about the center of turn 28. In addition to the example shown in FIG. 2, various other unaligned positions and relatively different or the same amounts of thrust of the marine propulsion devices 16*a*, 16*b* are possible to achieve one or both of a rotational movement and movement of the marine vessel 12 in any direction, including transversely to and along the longitudinal direction L. For example, the marine propulsion devices 16*a*, 16*b* do not have to be similarly oriented and could splay outwardly instead of inwardly to achieve desired movement of the vessel 12. As stated above, various other maneuvering strategies and mechanisms necessary to achieving same are described in the incorporated U.S. Pat. Nos. 6,234,853; 7,267,068; and 7,467,595.

The marine vessel 12 also includes a helm 19 where a user can input commands for maneuvering the marine vessel 12 via one or more input devices. As discussed above, the number and type of input devices can vary from the example shown. In FIGS. 1 and 2, the input devices include the joystick 22, steering wheel 24, shift and throttle lever 26, a touchscreen 28 and keypad 35. Rotation of the steering wheel 24 in a clockwise direction requests clockwise rotation or yaw of the marine vessel 12 about the center of turn 28. Counterclockwise rotation of the steering wheel 24 requests counterclockwise rotation or yaw of the marine vessel 12 about the center of turn 28. Forward pivoting of the shift and throttle lever 26 away from a neutral position requests forward gear and requests increased throttle. Rearward pivoting of the shift and throttle lever 26 away from a neutral position requests reverse gear and requests increasing rearward throttle. Actuation of the touchscreen 28 and keypad 35 inputs user-requested operational mode selections to the control circuit 14, as will be discussed further herein below.

Figure 5:
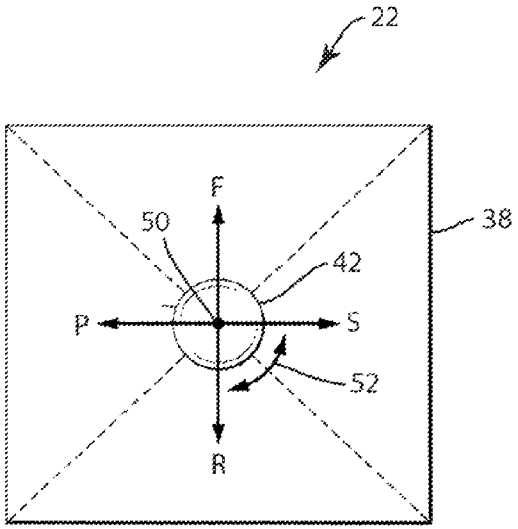
FIG. 5 is a top view of the joystick.
Figure 3:
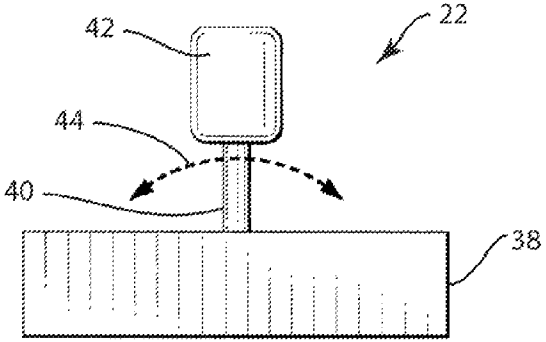
FIG. 3 is a side view of an input device in the form of a joystick.
Figure 4:
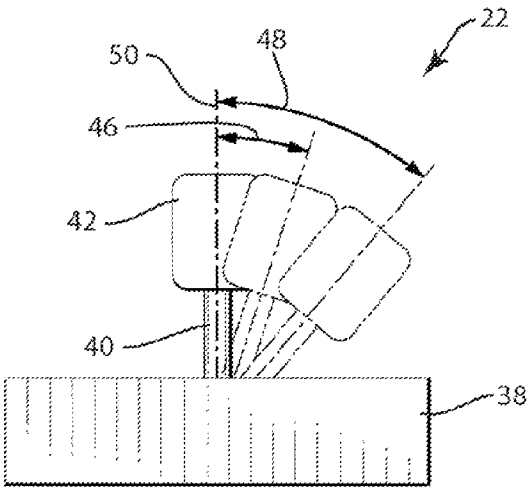
FIG. 4 is side view showing movement of the joystick.

A schematic depiction of a joystick 22 is depicted in FIGS. 3-5. The joystick 22 includes a base 38, a shaft 40 extending vertically upwardly relative to the base 38, and a handle 42 located on top of the shaft 40. The shaft 40 is movable, as represented by dashed line arrow 44 in numerous directions relative to the base 38. FIG. 4 illustrates the shaft 40 and handle 42 in three different positions which vary by the magnitude of angular movement. Arrows 46 and 48 show different magnitudes of movement. The degree and direction of movement away from the generally vertical position shown in FIG. 3 represents an analogous magnitude and direction of an actual movement command selected by a user. FIG. 5 is a top view of the joystick 22 in which the handle 42 is in a central, vertical, or neutral, position. The handle 42 can be manually manipulated in a forward F, reverse R, port P or starboard S direction to provide actual movement commands into F, R, P, S directions or any other direction therebetween. In addition, the handle 42 can be rotated about the centerline 50 of the shaft 40 as represented by arrow 52 to request rotational movement or yaw of the vessel 12 about the center of turn 28. Clockwise rotation of the handle 42 requests clockwise rotation of the marine vessel 12 about the center of turn 28, whereas counterclockwise rotation of the handle 42 requests counterclockwise rotation of the vessel about the center of turn 28. Various other joystick structures and operations are described in the incorporated U.S. Pat. Nos. 6,234,853; 7,267,068; and 7,467,595.

Figure 6:
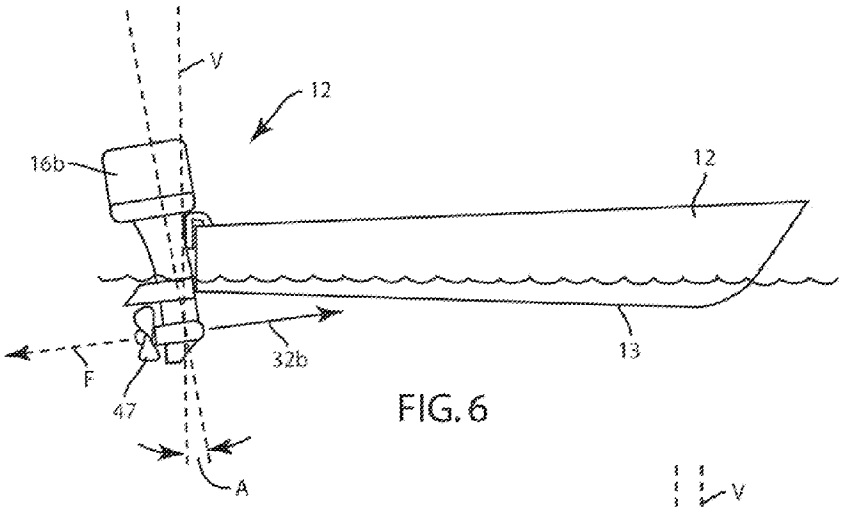
FIG. 6 is a side view of a marine vessel having a plurality of marine propulsion devices in a first trim position that is fully trimmed down.
Figure 7:
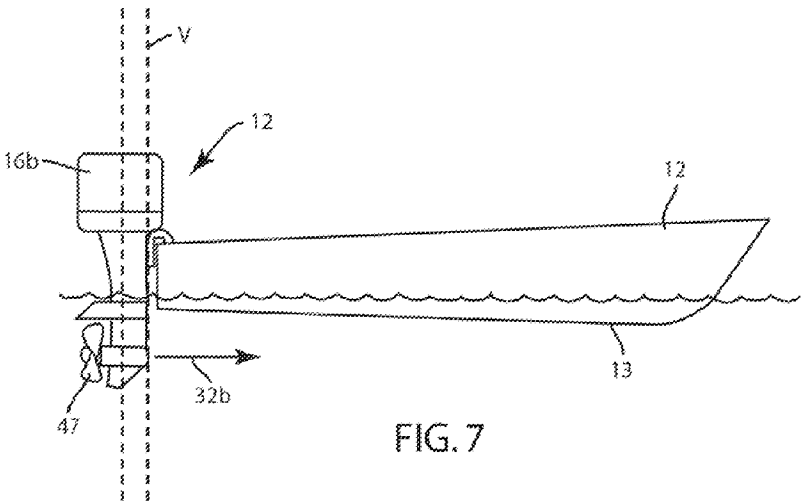
FIG. 7 is a side view of a marine vessel having a plurality of marine propulsion devices in a second trim position that is not fully trimmed down.

FIGS. 6 and 7 are schematic side views of the marine vessel 12. FIG. 6 depicts the marine propulsion devices 16*a*, 16*b* (only 16*b* is shown in side view) in a fully lowered trim position. The trim position depicted in FIG. 6 is a position that is conventionally utilized during initial forward acceleration (or launch) of the marine vessel 12 until full forward translation wherein the vessel 12 is on-plane. During such initial forward acceleration, the propulsor 47 (in this example a propeller) rotates forwardly to provide forward thrust shown in dashed line at F to propel the marine vessel forwardly. When the marine propulsion device 16*b* is at this conventional trim position for accelerating into forward translation of the marine vessel 12, the propulsion device 16*b* provides forward thrusts F that are angled with respect to the vertical direction V. Once the marine vessel 12 is in full forward translation and on plane, the marine propulsion devices 16*a*, 16*b* are typically trimmed back out of the trim position shown in FIG. 6, usually back past the vertical axis V to a slightly raised trim position that achieves, for example, optimal speed or fuel economy or other desired performance characteristics. Once the marine vessel 12 is thereafter slowed to a stop, the trim angle of the marine propulsion devices 16*a*, 16*b* typically does not change. In other words, the propulsion devices 16*a*, 16*b* remain in the trim position shown in FIG. 6 if the vessel 12 was slowed before it was on plane and in full forward translation or remain in the trimmed-up position away from vertical if the vessel 12 was slowed from full forward translation.

As shown in FIG. 6, when a reverse thrust 32*b* is requested after the marine propulsion device 16*b* has been left in the trimmed down position, the thrust 32*b* is still angled as shown at A with respect to vertical V. Depending on the amount of the angle A, the reverse thrust 32*b* will engage with or intersect with the hull 13 of the marine vessel 12 such that the hull 13 impedes the thrust 32*b*. The present inventors have realized that this results in inefficient thrust. As described further below, the rotational angle of the marine propulsion device 16*b* about the vertical axis V (or steering axis 30*b*, as described above) and the particular shape of the hull 13 will determine whether the reverse thrust 32*b* engages with the hull 13 when the propulsion devices 16*a*, 16*b* are in the trimmed down position, and to what extent. For example, many marine vessels have a keel portion that extends downwardly into the water and therefore when the marine propulsion device 16*b* is rotated into the trim and splayed positions shown in FIGS. 2 and 6, the reverse thrust 32*b* is more likely to intersect with the hull 13 of the marine vessel 12, thus resulting in inefficiency of thrust.

Further, the inventors have recognized that when the vessel 12 is in full forward translation and the marine propulsion devices 16*a*, 16*b* are rotated away from the first position and past vertical V, once the vessel stops, the devices 16*a*, 16*b* are left in a slightly raised trim position (away from vertical) and consequently are not efficiently oriented to utilize the full force of a reverse thrust.

FIG. 7 depicts the propulsion device 16*b* at an optimal trim position (with respect to the fully trimmed-down position shown in FIG. 6 and the trimmed-up position discussed above). In the trim position shown in FIG. 7, the reverse thrust 32*b* extends in a direction that does not intersect with the hull 13 of the marine vessel 12. In the example shown in FIG. 7, the trim angle of the marine propulsion device 16*b* is such that the reverse thrust 32*b* does not intersect with the hull 13 of the marine vessel 12 during any rotational orientation of the marine propulsion device 16*b* about the steering axis 30*b*, such as the orientations depicted in FIGS. 1, 2, or otherwise. Further, the trim angle of the marine propulsion device 16*b* is such that reverse thrusts 32*a* and 32*b* are not trimmed too far up away from vertical so as to efficiently achieve reverse or rotational movement. As can be seen by comparing FIGS. 6 and 7, the propulsion device 16*b* in the trim position shown in FIG. 6 is at a greater trim angle A from the vertical direction V than when the propulsion device 16*b* is in the trim position shown in FIG. 7. In the example of FIG. 7, the trim position is substantially perpendicular to vertical V. This is an optional orientation and in other examples, the marine propulsion device 16*b* can be acutely or obtusely angled with respect to the vertical direction V and still avoid intersection with (and thus interference by) the hull 13. The preferred angle of trim can vary and can be determined based, in part, upon the particular geometry of the hull and the particular rotational angle of the propulsion device about its steering axis. In general, it has been found to be preferable to limit the impact of the hull on the reverse thrust by angling the reverse thrust. Generally, however, the optimal trim position can be selected so as to provide the most effective utilization of thrust.

Figure 8:
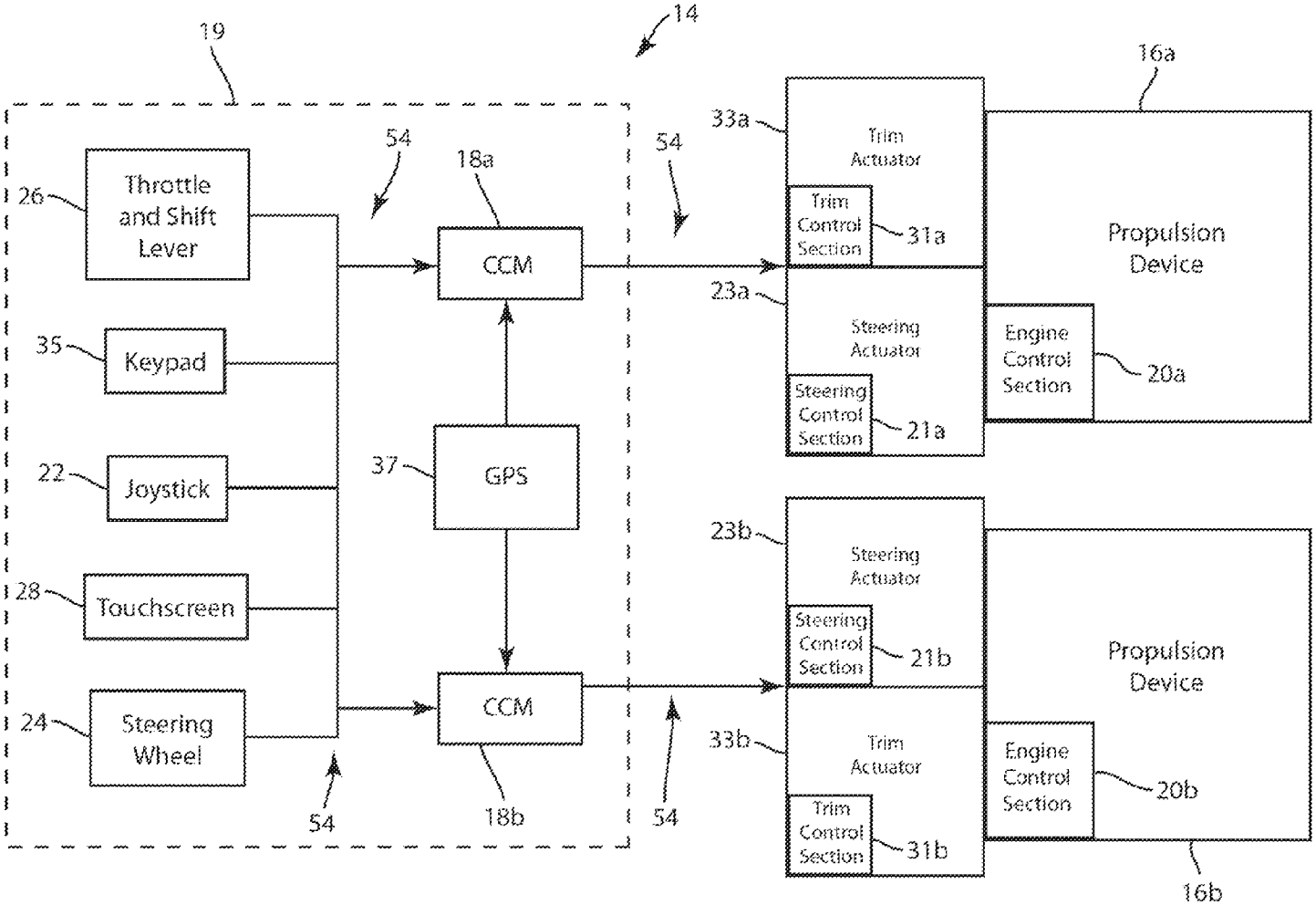
FIG. 8 is a schematic depiction of a control circuit for controlling a plurality of marine propulsion devices.

Referring to FIG. 8, the input devices 22, 24, 26, 28, and 35 communicate with control circuit 14, which in the example shown is part of a control circuit area network 54. It is not required that the input devices 22, 24, 26, 28 and 35 communicate with the control circuit 14 via the control circuit area network 54. For example, one or more of these items can be connected to the control circuit by hard wire or wireless connection. The control circuit 14 is programmed to control operation of marine propulsion devices 16*a*, 16*b*; steering actuators 23*a*, 23*b*; and trim actuators 33*a*, 33*b* associated therewith. As discussed above, the control circuit 14 can have different forms. In the example shown, the control circuit 14 includes a plurality of command control sections 18*a*, 18*b* located at the helm 19. A command control section 18*a*, 18*b* is provided for each marine propulsion device 16*a*, 16*b*. The control circuit 14 also includes an engine control section 20*a*, 20*b* located at and controlling operation of each respective propulsion device 16*a*, 16*b*, a steering control section 21*a*, 21*b* located at and controlling operation of each steering actuator 23*a*, 23*b*, and a trim control section 31*a*, 31*b* located at and controlling operation of each trim actuator 33*a*, 33*b*. In another example, the trim control sections 31*a*, 31*b* can be part of and located with the engine control sections 20*a*, 20*b*, respectively. Each control section has a memory and processor for sending and receiving electronic control signals, for communicating with other control circuits in the control circuit area network 54, and for controlling operations of certain components in the system 10 such as the operation and positioning of marine propulsion devices 16*a*, 16*b* and related steering actuators 23*a*, 23*b* and trim actuators 33*a*, 33*b*. Examples of the programming and operations of the control circuit 14 and its sections are described in further detail below with respect to non-limiting examples and/or algorithms. While each of these examples/algorithms includes a specific series of steps for accomplishing certain system control functions, the scope of this disclosure is not intended to be bound by the literal order or literal content of steps described herein, and non-substantial differences or changes still fall within the scope of the disclosure.

In the example shown, each command control section 18*a*, 18*b* receives user inputs via the control circuit area network 54 from the joystick 22, steering wheel 24, shift and throttle lever 26, touch screen 28 and keypad 35. As stated above, the joystick 22, steering wheel 24, shift and throttle lever, and keypad 35 could instead be wired directly to the CCM 18*a* instead of via the control circuit area network 54. Each command control section 18*a*, 18*b* is programmed to convert the user inputs into electronic commands and then send the commands to other control circuit sections in the system 10, including the engine control sections 20*a*, 20*b*; steering control sections 21*a*, 21*b* and trim control sections 31*a*, 31*b*. For example, when the shift and throttle lever 26 is actuated, as described above, each command control section 18*a*, 18*b* sends commands to the respective engine control sections 20*a*, 20*b* to achieve the requested change in throttle and/or shift. Rotation of the shift and throttle lever 26 in an aftward direction will enable a "reverse mode" wherein reverse thrust is requested of the marine propulsion devices 16*a*, 16*b* to achieve reverse movement of the marine vessel 12. Further, when the steering wheel 24 is actuated, as described above, each command control section 18*a*, 18*b* sends commands to the respective steering control sections 21*a*, 21*b* to achieve the requested change in steering. When the joystick 22 is moved out of its vertical position, each command control section 18*a*, 18*b* sends commands to the respective engine control section 20*a*, 20*b* and/or steering control section 21*a*, 21*b* to achieve a movement commensurate with the joystick 22 movement. When the handle 42 of the joystick 22 is rotated, each command control section 18*a*, 18*b* sends commands to the respective steering control section 21*a*, 21*b* to achieve the requested vessel yaw or rotation. Movement of the joystick 22 out of its vertical position effectively engages a "joystick mode" wherein the control circuit 14 controls operation and positioning of the marine propulsion devices 16*a*, 16*b* based upon movement of the joystick 22. As explained above, each respective propulsion device 16*a*, 16*b* can move into and out of the aligned position shown in FIG. 1 when the joystick 22 is moved out of its vertical position.

Actuation of the touchscreen 28 and/or keypad 35 can enable a "stationkeeping mode", wherein the control circuit 14 receives inputs from a GPS receiver 37 and thereby controls the propulsion devices 16*a*, 16*b* and related steering actuators 23*a*, 23*b* to maintain a selected global position of the marine vessel 12. Stationkeeping mode is well described in the art, such as the herein incorporated U.S. Pat. No. 7,267,068, and therefore is understood by those having ordinary skill in the art. An example of a suitable GPS receiver is the Maretron GPS200; however, other types of GPS receivers are available and would work with the systems and methods described herein. The GPS receiver 37 is configured to receive GPS satellite signals and calculate the current global position of the marine vessel 12, as well as optionally the current speed of the marine vessel in terms of speed over ground (SOG) and course over ground (COG) and communicate this information to the control circuit 14. This type of GPS receiver and control circuit configuration is well known to those having ordinary skill in the art.

As stated herein above, the present disclosure derives from the present inventors' research and development of systems and methods for maneuvering marine vessels. Through experimentation, the inventors have determined that prior art systems and methods for maneuvering marine vessels often position marine propulsion devices at inefficient and/or ineffective trim angles during certain operational modes. For example, the present inventors have determined that during "docking modes", when a joystick or similar input device is utilized to achieve transverse movements of the marine vessel 12, the marine propulsion devices 16*a*, 16*b* are often oriented towards a center of turn 28 of the marine vessel 12 and set at a trim angle such that the reverse thrusts 32*a*, 32*b* of the devices 16*a*, 16*b* impact the hull 13 of the marine vessel 12. For example, typical control systems leave the marine propulsion devices 16*a*, 16*b* at the trim angle utilized during the last operation of the marine vessel 12. If the marine vessel 12 is slowed immediately after acceleration, the propulsion devices 16*a*, 16*b* are typically left at the trim angle A shown in FIG. 6. Conversely, if the marine vessel 12 is slowed and stopped from full forward translation, the marine propulsion devices 16*a*, 16*b* are typically at a trimmed-up position, away from vertical V. Thereafter, if the operator of the vessel 12 requests movement of the marine vessel that requires reverse thrust 32*a*, 32*b*, the reverse thrust will be inefficiently utilized because the trim angle of the propulsion devices 16*a*, 16*b* is not efficiently set. The inventors have determined that this creates inefficiency in the operation of the system. This type of deficiency can occur during operational modes of the system, such as in stationkeeping mode wherein the marine propulsion devices 16*a*, 16*b* are oriented to maintain a global position of the marine vessel 12, and reverse mode wherein the propulsion devices 16*a*, 16*b* provide reverse thrusts 32*a*, 32*b* to achieve reverse translation of the marine vessel 12. Upon this realization, the present inventors determined that it would be beneficial to provide a system that automatically trims the marine propulsion devices 16*a*, 16*b* to a more optimal or efficient trim angle when reverse thrusts 32*a*, 32*b* from the propulsion devices 16*a*, 16*b* are requested.

The system depicted in FIGS. 1-8 has thus been configured to control the propulsion devices 16*a*, 16*b* to move into an optimal (e.g. a second) trim position, such as for example the position shown in FIG. 7, wherein reverse thrusts from the propulsion devices 16*a*, 16*b* do not intersect with the hull 13 of the marine vessel 12. The control circuit 14 is programmed to control the propulsion devices 16*a*, 16*b* to move into the second trim position when a reverse thrust of the respective propulsion device 16*a*, 16*b* is requested. Movement of the propulsion devices 16*a*, 16*b* can be linked such that the propulsion devices 16*a*, 16*b* are trimmed in unison. Alternately, movement of the propulsion devices 16*a*, 16*b* can be independent and can independently depend upon whether a reverse thrust is requested from that particular device. In one example, the control circuit 14 is programmed to control the respective propulsion devices 16*a*, 16*b* to move from a first trim position such as the position shown in FIG. 6 wherein the propulsion device 16*a*, 16*b* defines reverse thrusts 32*a*, 32*b* that intersect with the hull 13 (or from, for example, a trimmed-up position with respect to vertical V) to a second trim position (FIG. 7) wherein the reverse thrusts 32*a*, 32*b* does not intersect with the hull 13.

The control circuit 14 can be programmed to control operation of the propulsion devices 16*a*, 16*b*, and specifically the trim position of the respective device according to a particular operational mode selected by the user that requests reverse thrust. Examples of these operational modes are provided above and can include stationkeeping mode wherein the control circuit 14 controls operation of the respective marine propulsion device 16*a*, 16*b* to maintain a global position of the marine vessel 12, docking mode wherein the control circuit 14 controls operation of the propulsion device 16*a*, 16*b* to achieve a transverse movement of the marine vessel 12, and reverse mode wherein the control circuit 14 controls operation of the propulsion device 16*a*, 16*b* to achieve a reverse translation of the marine vessel 12.

The control circuit 14 can also be programmed to control operation of the propulsion devices 16*a*, 16*b*, and specifically the trim position of the respective device, according to inputs from one of the user input devices, such as for example the touchscreen 28 and/or keypad 35. In this example, the control circuit 14 can be programmed to automatically indicate to an operator of the marine vessel that based upon a request for reverse thrust inputted by, for example, a user input device, or as required by a certain operational mode, movement of the marine propulsion devices 16*a*, 16*b* into the optimal trim position (e.g. the trim position shown in FIG. 7) is desirable. Thereafter, the control circuit 14 can control movement of the marine propulsion devices 16*a*, 16*b* into the optimal trim position upon receiving an operator input from one of the input devices, for example the touchscreen 28 or keypad 35. The touchscreen 28 can comprise an indicator device such as a visual indicator or alert indicating to the operator that movement of the marine propulsion devices 16*a*, 16*b* into the optimal trim position is desirable. The touchscreen 28 or keypad 35 can also allow for operator input to indicate to the control circuit 14 that movement of the respective propulsion devices 16*a*, 16*b* into the optimal trim position is desired. Thereafter, the control circuit 14 can be programmed to control operation of the propulsion devices 16*a*, 16*b*, and specifically the trim position of the respective device(s) to achieve the optimal trim position.

Figure 9:
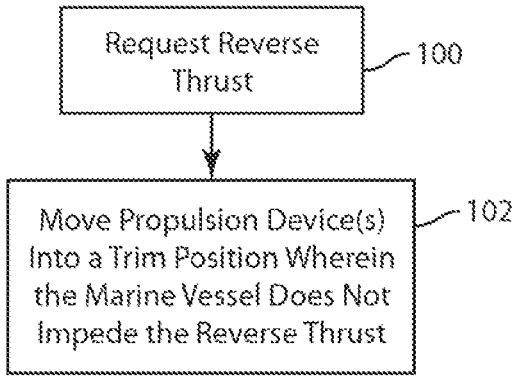
FIG. 9 is a flow chart depicting one example of a method of maneuvering a marine vessel.

FIG. 9 depicts one example of a method for maneuvering a marine vessel utilizing, for example, the systems described hereinabove. At step 100, a control circuit is operated to process a request for a reverse thrust of a marine propulsion device associated with the marine vessel. At step 102 the control circuit is operated to process the request for reverse thrust and control the marine propulsion device(s) to move into a trim position wherein the marine vessel does not impede the reverse thrust.

Figure 10:
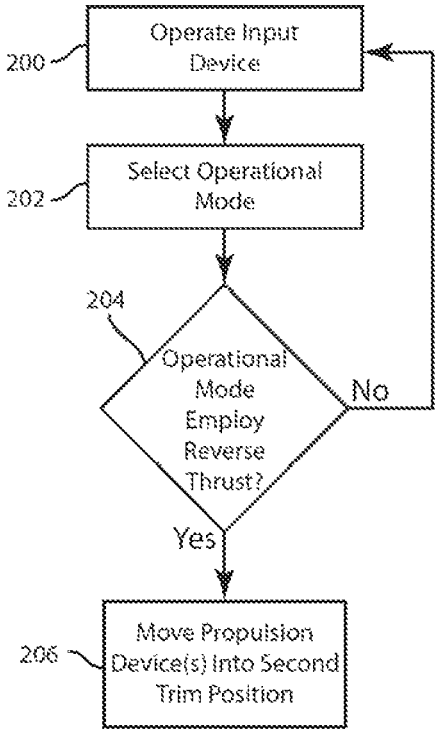
FIG. 10 is a flow chart depicting another example of a method of maneuvering a marine vessel.

FIG. 10 depicts another example of a method of maneuvering a marine vessel utilizing, for example, the systems described above. At steps 200 and 202, an input device is operated for requesting an operational mode requiring reverse thrust of at least one of a plurality of marine propulsion devices. At step 204, the control circuit determines whether the operational mode is a stationkeeping mode, reverse mode, or some other mode that employs reverse thrust from one or more of the propulsion devices. At step 206, the control circuit controls the marine propulsion device to move from an initial (first) trim position to a more optimal (second) trim position wherein the marine vessel impedes the reverse thrust in the first trim position to a larger degree than when the propulsion device is in the second trim position. As with the examples described above, the propulsion device can define a reverse thrust vector in a direction that intersects with the marine vessel in the first trim position. In the second trim position, the respective propulsion device can define a reverse thrust vector that does not intersect with the marine vessel.

Figure 11:
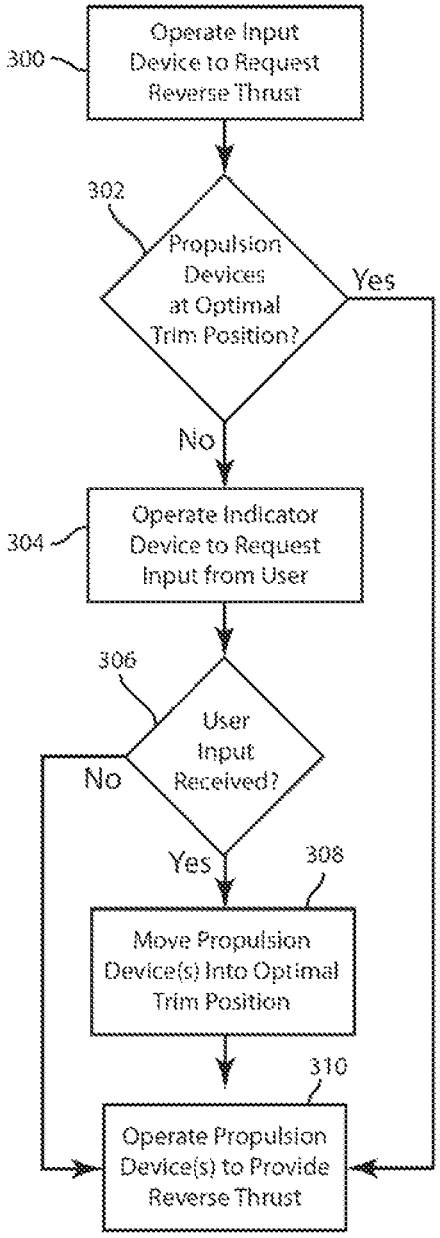
FIG. 11 is a flow chart depicting another example of a method of maneuvering a marine vessel.

FIG. 11 depicts another example of a method of maneuvering a marine vessel utilizing, for example, the systems described above. At step 300, an input device is operated for requesting a reverse thrust from one of a plurality of marine propulsion devices. Request of the reverse thrust can be via a request for a certain operational mode that utilizes reverse thrust, or a direct request for reverse thrust via for example a shift/lever. At step 302, a control circuit determines whether the propulsion devices are at an optimal trim position for utilizing reverse thrust. If yes, the control circuit operates the propulsion devices to provide the reverse thrust. If no, at step 304, the control circuit controls operation of an indicator device, such as a touchscreen, to indicate to the operator that the propulsion devices are not at an optimal trim position for a reverse thrust and request the operator to input a request for trim of the marine propulsion devices into the optimal trim position. The input device can comprise for example a touchscreen or keypad and/or the like. At step 306, the control circuit determines whether a request for trim has been received from the input device. If yes, at step 308, the control circuit controls movement of the propulsion devices into the optimal trim position. If no, at step 306, the control circuit proceeds to step 310. Thereafter, at step 310, the control circuit operates the propulsion devices to provide the requested reverse thrust.

It will thus be recognized by those having ordinary skill in the art that the present disclosure provides means for controlling movement of marine propulsion devices into an optimal trim position wherein the marine propulsion device provides a reverse thrust that is not impeded by a hull of the vessel and wherein the reverse thrust is more efficiently utilized.

What is claimed is:

1. A system for maneuvering a marine vessel comprising a hull, the system comprising:

a marine propulsion device that provides at least a reverse thrust with respect to the marine vessel, the propulsion device being vertically pivotable between at least a first trim position and a second trim position, wherein the hull impedes the reverse thrust of the propulsion device in the first trim position to a larger degree than when the propulsion device is in the second trim position; and a control circuit controlling the propulsion device to move into the second trim position when the reverse thrust of the propulsion device is requested;

wherein the control circuit controls movement of the propulsion device into the second trim position upon request for an operational mode that requests the reverse thrust; and wherein the operational mode comprises one of a station-keeping mode wherein the control circuit controls operation of the marine propulsion device to maintain a global position of the marine vessel; a docking mode wherein the control circuit controls operation of the propulsion device to achieve a transverse movement of the marine vessel; and a reverse mode wherein the control circuit controls operation of the propulsion device to achieve reverse translation of the marine vessel.

2. A system according to claim 1, comprising a user input device operable to request the operational mode.

3. A system according to claim 2, wherein the user input device comprises a joystick.

4. A system for maneuvering a marine vessel comprising a hull, the system comprising: a marine propulsion device that pro ides at least a reverse thrust with respect to the marine vessel, the propulsion device being vertically pivotable between at least a first trim position and a second trim position, wherein the hull impedes the reverse thrust of the propulsion device in the first trim position to a larger degree than when the propulsion device is in the second trim position; and a control circuit controlling the propulsion device to move into the second trim position when the reverse thrust of the propulsion device is requested;

wherein the control circuit comprises a command control section and at least one engine control section, at least one steering control section, and at least one trim control section.

5. A system according to claim 4, wherein the propulsion device in the first trim position defines a reverse thrust vector that extends in a direction that intersects with the hull and wherein the propulsion device in the second trim position defines a reverse thrust vector that extends in a direction that does not intersect with the hull of the marine vessel and wherein the control circuit controls the propulsion device to move from the first trim position to the second trim position when the reverse thrust of the propulsion device is requested.

6. A system according to claim 4, wherein the propulsion device in the first trim position is at a greater trim angle from vertical than when the propulsion device is in the second trim position.

7. A system according to, claim 4, wherein the propulsion device comprises one of a plurality of propulsion devices that each provide forward and reverse thrusts with respect to the marine vessel, the plurality of propulsion devices being pivotable between at least the first trim position and the second trim position; and wherein the control circuit controls respective propulsion devices in the plurality of propulsion devices to move into the second trim position when a reverse thrust of the respective propulsion devices is requested.

8. A system for maneuvering a marine vessel, the system comprising:

an input device for requesting a reverse thrust of a marine propulsion device; and a control circuit that, based upon a request for the reverse thrust from the input device, controls movement of the marine propulsion device into a trim position wherein the marine propulsion device provides a reverse thrust that is not impeded by a hull of the marine vessel;

wherein the control circuit controls movement of the marine propulsion device into the trim position upon receiving an operator input; and an indicator device, wherein the control circuit controls the indicator device to indicate to an operator that based upon the request for reverse thrust, movement of the marine propulsion device into the trim position is desirable.

9. A system according to claim 8, wherein the input device comprises a joystick.

10. A system according to claim 8, wherein the marine propulsion device is pivotable between a first trim position in which the hull interferes with a reverse thrust of the marine propulsion device and a second trim position in which the hull provides comparatively less interference with the reverse thrust of the marine propulsion device than the first trim position; and wherein the control circuit controls pivoting of the marine propulsion device into the first trim position when the reverse thrust is requested.

11. A system according to claim 10, wherein in the second trim position, the marine propulsion device defines at least one thrust vector that is acutely angled with respect to vertical.

12. A system according to claim 10, wherein in the second trim position, the marine propulsion device defines at least one thrust vector that is substantially perpendicular to vertical.

13. A system according to claim 8, wherein the indicator device comprises a touchscreen.

14. A method of maneuvering a marine vessel, the method comprising:

operating a control circuit to process a request for reverse thrust of a marine propulsion device associated with the marine vessel;

controlling with the control circuit the marine propulsion device to move into a trim position wherein the marine vessel does not impede the reverse thrust;

controlling with the control circuit the marine propulsion device to move from a first trim position to a second trim position, wherein the marine vessel impedes the reverse thrust in the first trim position to a larger degree than when the propulsion device is in the second trim position;

controlling, with the control circuit, movement of the marine propulsion device into the trim position upon receiving an operator input; and operating an indicator device to indicate to an operator that based upon the request for reverse thrust, movement of the marine propulsion device into the trim position is desirable.

15. A method according to claim 14, wherein in the first trim position, the propulsion device defines a reverse thrust vector that intersects with the marine vessel and wherein in the second trim position, the respective propulsion device defines a reverse thrust vector that does not intersect with the marine vessel.

16. A method according to claim 14, wherein in the first trim position, the propulsion device is at a comparatively greater trim angle from vertical than in the second trim position.

17. A method according to claim 14, comprising operating a user input device to request the reverse thrust of the propulsion device.

18. A method according to claim 14, comprising operating the user input device to select an operational mode that requires the reverse thrust of the respective propulsion device.

19. A method according to claim 14, wherein a touch screen comprises the indicator device.

* * * * *